US009931555B1

(12) United States Patent
McCoy

(10) Patent No.: US 9,931,555 B1
(45) Date of Patent: Apr. 3, 2018

(54) TRAINING SYSTEM FOR BASKETBALL PLAYER TRAINING

(71) Applicant: Durwood McCoy, San Jose, CA (US)

(72) Inventor: Durwood McCoy, San Jose, CA (US)

( * ) Notice: Subject to any disclaimer, the term of this patent is extended or adjusted under 35 U.S.C. 154(b) by 0 days.

(21) Appl. No.: 15/414,026

(22) Filed: Jan. 24, 2017

(51) Int. Cl.
*A63B 69/00* (2006.01)

(52) U.S. Cl.
CPC ..... *A63B 69/0071* (2013.01); *A63B 69/00* (2013.01); *A63B 69/002* (2013.01); *A63B 2069/0004* (2013.01); *A63B 2208/0204* (2013.01)

(58) Field of Classification Search
CPC ..... A63B 69/0071; A63B 2208/0204
USPC ..... 473/422, 450, 458, 434, 435, 438, 445, 473/449, 451, 462, 446, 447, 476–478
See application file for complete search history.

(56) References Cited

U.S. PATENT DOCUMENTS 1,266,494 A * 5/1918 Lakin ..... F41J 5/18 273/381
3,471,966 A * 10/1969 Kratzer ..... A63H 13/16 446/366
3,675,921 A * 7/1972 Meyers, Sr. ..... A63B 69/0071 473/448
3,969,837 A * 7/1976 Kresse ..... G09F 17/00 116/173
4,168,062 A * 9/1979 McCarthy ..... A63B 63/06 473/446
4,489,940 A * 12/1984 Amundson ..... A63B 69/0026 473/435
D321,370 S * 11/1991 Curtis ..... 473/447
5,125,651 A 6/1992 Keeling et al.
5,365,427 A 11/1994 Soignet et al.
5,527,185 A * 6/1996 Davis ..... A63B 69/34 434/247
5,665,016 A 9/1997 Burnett
5,772,538 A * 6/1998 Sztykiel ..... A63B 63/00 473/446
5,776,018 A 7/1998 Simpson et al.
5,816,951 A * 10/1998 Hudock ..... A63B 69/34 423/446
D658,242 S * 4/2012 McDonald ..... D21/698
8,206,246 B2 6/2012 Joseph et al.
8,277,340 B1 * 10/2012 Devine ..... A63B 69/0071 473/422
9,017,188 B2 4/2015 Joseph et al.
9,233,292 B2 1/2016 Joseph et al.
9,498,693 B1 * 11/2016 Kraus ..... A63B 69/345 473/438
2005/0159250 A1 * 7/2005 Elder ..... A63B 69/002 473/446
2007/0225089 A1 * 9/2007 Jones ..... A63B 69/34 473/447
2009/0149281 A1 * 6/2009 Johnson ..... A63B 69/34 473/447
2010/0160093 A1 6/2010 Macarthur
2010/0261557 A1 11/2010 Joseph et al.

FOREIGN PATENT DOCUMENTS

FR 2582529 A1 * 12/1986 ..... A63B 69/34
FR 2709474 A1 * 3/1995 ..... B65D 71/0022

* cited by examiner

*Primary Examiner* — Mitra Aryanpour

(57) ABSTRACT

The invention is a training system used to train basketball players. The training system is specifically used for training players to make successful shots in the face of defensive player motion blocking and shot blocking/deflection tactics.

3 Claims, 3 Drawing Sheets

Rear

TRAINING SYSTEM FOR BASKETBALL PLAYER TRAINING

TECHNICAL FIELD

The present invention relates to athletic training and tools for same.

BACKGROUND OF THE INVENTION

In basketball, now a globally popular sport, a player on offense will ultimately attempt to toss the ball up and into the basket. This is called "taking a shot." A player on defense will attempt to block or deflect the offensive player's shot. Thus, one important skill that trainers of basketball players must work to improve is the ability of the offensive player to thwart the block or deflection. Blocking and deflecting comprises two aspects. One is physical blocking of the offensive player's movement; the other is using arms and hands to block or deflect the ball. Currently, trainers have ad hoc tools for training against physical blocking, and makeshift tools for training against shot blocking and deflection. There is no combinational tool that is designed to do both—emulate physical blocking and shot blocking and deflection.

BRIEF SUMMARY OF THE INVENTION

The system disclosed and claimed herein is a single tool for emulating physical blocking and shot blocking and deflection tactics. The system comprises four components: a lower component similar in size and shape to a rectangular cushion; a middle component that resembles a player's upper torso and is made of thin material with a transparent grid texture attached to an outer frame that gives it rigidity. The top component is made of the same transparent and framing material as the middle subsystem but is shaped to resemble upraised arms and hands and a player's head in between the arms. The three components are held in place by a rigid pole that will not flex noticeably when pushed on. The bottom component serves as the anchor for one end of the rigid pole, and the middle and top components are held in place by suitable attachment fixtures such that they remain in a fixed position along the pole length. The top and middle components are also kept in a planar orientation to one another, and the plane of the top two components is essentially parallel to the planes of the front and rear faces of the bottom subsystem. Three handhold structures are located on the bottom subsystem's rear face to allow the user to use both arms and hands to hold and maneuver the system while maintaining a secure grip.

BRIEF DESCRIPTIONS OF THE DRAWINGS

Figure 1A:
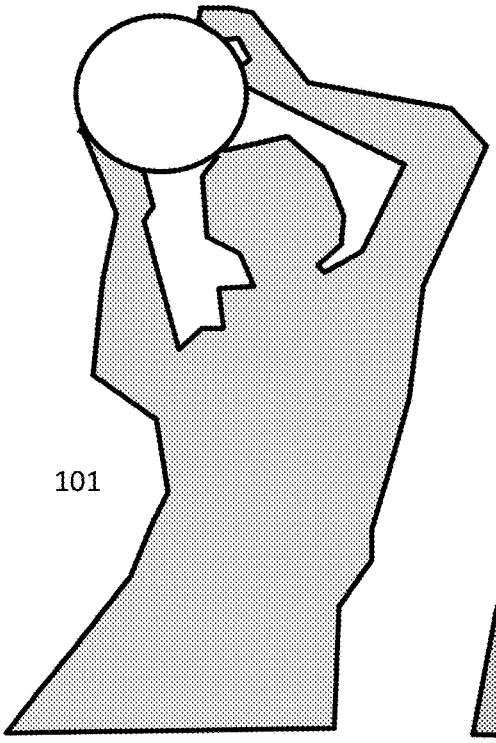
Figure 1B:
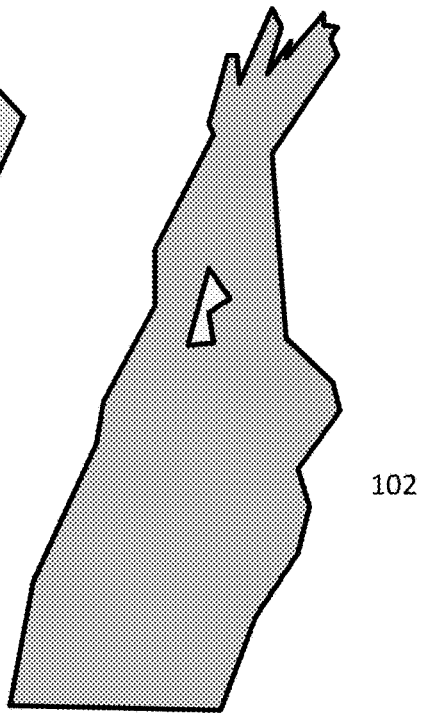

FIGS. 1 A and B depicts an offensive player attempting to make a shot while a defensive player attempts to block or deflect the shot.

Figure 2:
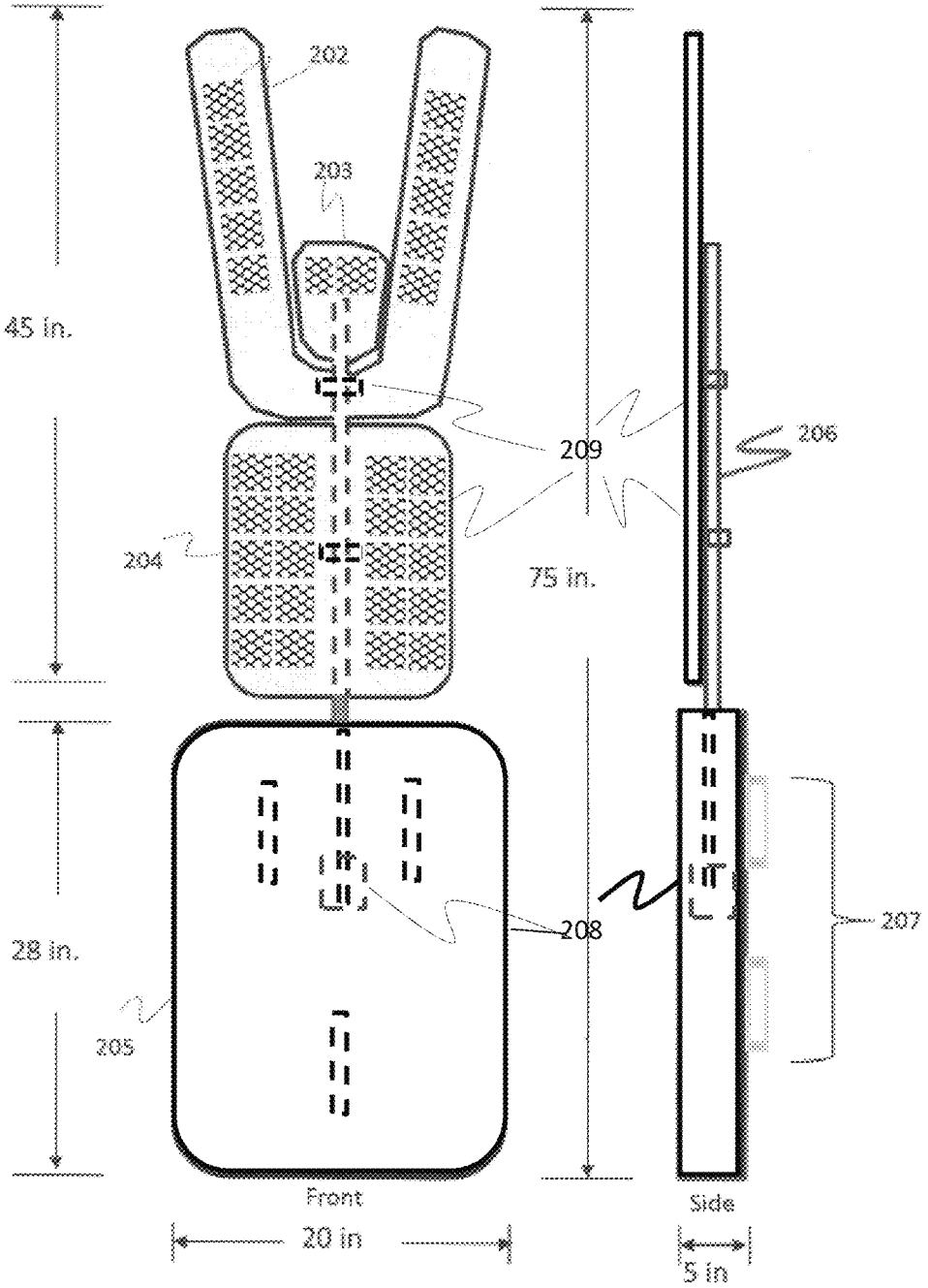

FIGS. 2 A and B depicts an embodiment of the system comprising the subsystems and their juxtapositions and dimensions. Both a front and side view are shown.

Figure 3:
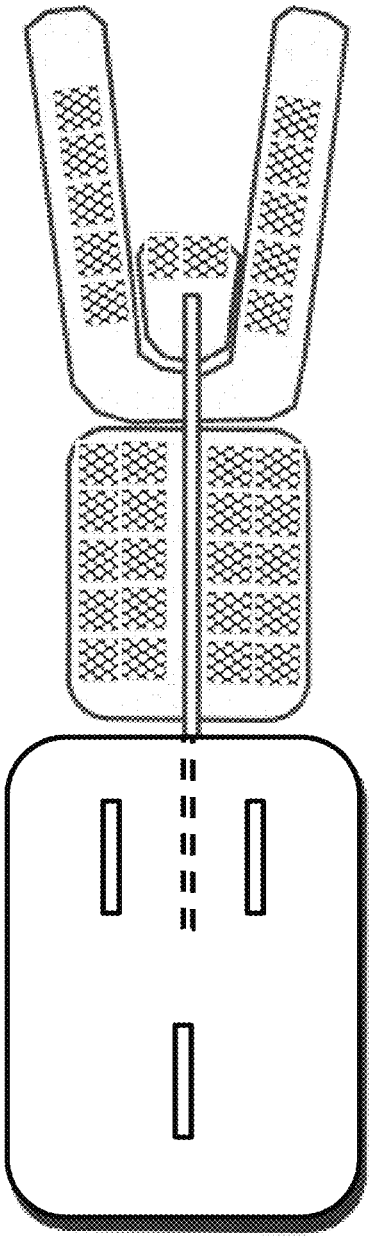

FIG. 3 depicts the same embodiment of the system with a rear view of the subsystems and their juxtapositions.

DETAILED DESCRIPTION OF THE INVENTION

Basketball, which began as an American sport in the late 1800s, has become a globally popular sport. Amateur basketball teams exist in many schools, clubs and universities. Professional basketball teams are hosted in over 60 countries worldwide. In every case, amateur or professional, trainers are tasked with improving the offensive shot skills of their players. Points are made in basketball by tossing (also known as shooting) the basketball into the basket. During play, with exception of foul-shot penalties, offensive players attempting to shoot the ball into the basket are opposed by defensive players attempting to block their motion and block and/or deflect their shots. Thus, an important skill for trainers to focus on is that of an offensive player making a successful shot despite defensive player blocking tactics.

Currently, trainers use ad hoc and makeshift tools for such training. For example, a cushion with rear handhold might be used for physical blocking emulation, and broom might be used for shot blocking and deflection.

The system herein disclosed and claimed is designed to provide both motion blocking and shot blocking and deflection tactics emulation. When assembled, the system provides a unitary tool for both training practices (e.g. motion blocking and shot blocking/deflection). When disassembled, the system is easily contained in a carrying case and transported to where needed.

In basketball, shooting accuracy increases as a player gets closer to the basket. It is common for several players, both offensive and defensive, to quickly congregate in the near-basket area. This is where the highest percentage of successful shots is made; and the area in which defensive players use motion blocking and shot blocking/deflection tactics.

FIG. 1 A shows an offensive player (101) preparing to shoot the basketball and 1B shows a defensive player (102) poised to block the first player's motion and to block and/or deflect any shot. Note that it is common for the defensive player to present a frontal motion block while raising both arms and hands to try to defend against a successful shot. An effective training system, therefore, should resemble a defensive player's stance and arm/hand positions.

FIG. 2 A depicts an embodiment of the training system shown from a front view (facing the trainee) and 2B shows a side view. The bottom component (201) is a cushion-shaped structure with an outer cover and internal shock-absorbing filler. Two larger area faces are called front and back faces. A front face is oriented essentially vertical and directed toward the trainee and a rear face is oriented essentially vertical and directed toward the trainer. There are smaller area side, top and bottom faces. The top face is essentially oriented horizontally and is on top of the component, and the bottom face is essentially oriented horizontally and on the bottom of the component. The side faces are oriented essentially vertical and their planes are essentially perpendicular to the plane of the trainer. The bottom component is nominally 28 inches tall, 20 inches wide and 5 inches deep. These dimensions are not critical and can vary marginally without affecting system performance. The middle component (202) and top component (203) have an overall nominal height of 45 inches. Width (not shown) is nominally 17 inches with the upper most part of 203 (e.g. hands) nominally 18 inches wide. The overall height of the system from the bottom edge of the bottom subsystem to the top edge of 203 is nominally 75 inches. These dimensions can vary marginally without affecting system performance.

Looking at the side view, FIG. 2B, note that the rigid pole (204) is inserted into an anchoring structure 208 in the bottom component and positioned such that it extends upward from a point essentially halfway between the sides of the component's top face portion. The axis of the pole, then, would be nominally 10 inches from the vertical side faces of the bottom component and 2.5 inches from the front and back faces of the bottom component.

Attachment fixtures 209 attach components 202 and 203 to the pole in predetermined positions. When attached, the planes of 203 and 202 are coplanar, and are parallel to the planes of the front and rear faces of the 201. On the rear face of 201 (as shown in the side view, FIG. 2B), there are handholds that allow hand, wrist and arms to pass through them. The front view of 201 shows three such handholds, with two upper handholds and one lower handhold. By using one arm for the upper handhold and the other for the lower handhold, a trainer can maintain a firm grip while maneuvering the system up and/or down, or side to side, or pivoting from a vertical orientation to one side or the other. In this way, the system can emulate essentially all the blocking and deflection tactics of a defensive player.

FIG. 3 shows the rear view of the system. This is the portion that faces the trainer and faces away from the trainee. The rigid rod, as shown, is to the rear of middle and upper components, and embedded in the bottom component. As such, the rod does not obstruct the trainer's arm which extends through both upper handholds.

The outer casing, or cover, of the bottom component may be made of canvas, plastic, or any durable material commonly used for a cushion cover. Inside the cover, shock absorbing filler could be used to absorb some of the energy produced by body contact occurring during motion blocking. The rod anchor point could be a sleeve of similar rigid material, held firmly in place, that provides a snug fit for the rigid rod and a keyway fixture that keeps the rod fixed in position and unable to rotate on its axis.

The middle and upper components can be made of durable transparent mesh material held in place and in shape by a rigid frame structure. The rigid frame could be metallic or resinous material that holds its shape while allowing some flexibility if pushed against. The rigid rod can be wood, polyvinyl chloride (PVC), aluminum or virtually any material that is light in weight yet sufficiently rigid.

The embodiment shown in the FIGS. 2 and 3 is meant to be exemplary. It should not be read as limiting the scope of the invention.

What is claimed is:

1. A system comprising:

a bottom component formed of a shock absorbing material having a plurality of hand grips for holding and manipulating said system;

a middle component comprising a first section of see-through mesh material;

said middle component comprises a first peripheral frame of rigid material to which said first section of see-through mesh material is affixed therebetween so as to be stretched taut;

an upper component comprising a second section of see-through mesh material;

said upper component comprises a second peripheral frame of rigid material to which said second section of see-through mesh material is affixed therebetween so as to be stretched taut;

a rigid cylindrical rod;

said rigid cylindrical rod inserted into and secured in an opening formed on a top face of said bottom component such that when said rigid cylindrical rod is inserted within said opening, said rigid cylindrical rod is perpendicular to and extends above said top face;

wherein said rigid cylindrical rod further supports said middle and said upper components in a fixed orientation such that said middle and said upper components are essentially coplanar;

wherein said first section of said middle component and said second section of said upper component permit a user to see-through each section while manipulating said bottom, middle and upper components to simulate blocking and deflection tactics, and said see-through mesh material of said middle and upper components allow transparency and efficient movement broadside to said middle and upper components due to reduced air friction through said mesh material.

2. The system as in claim 1 further comprising:

said middle component attaches to and can be removed from said rigid cylindrical rod using a first attachment fixture;

said upper component attaches to and can be removed from said rigid cylindrical rod using a second attachment fixture, and;

said first and second attachment fixtures hold said middle and upper components, respectively, in a fixed position on said rigid cylindrical rod.

3. The system as in claim 2 further comprising:

an insertion anchoring fixture formed within said bottom component and in communication with said opening formed on the top face of said bottom component, wherein said rigid cylindrical rod is inserted into said opening and is anchored by said anchoring fixture.

* * * * *